US006435278B1

(12) United States Patent
Barlow et al.

(10) Patent No.: US 6,435,278 B1
(45) Date of Patent: Aug. 20, 2002

(54) FIRING HEAD/PERFORATING GUN LATCHING SYSTEM AND ASSOCIATED METHODS

(75) Inventors: Darren Ross Barlow, Grapevine; Roger Charles Watson, Frisco, both of TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 19 days.

(21) Appl. No.: 09/634,471

(22) Filed: Aug. 9, 2000

(51) Int. Cl.[7] ..... E21B 43/1185
(52) U.S. Cl. ..... 166/297; 166/55.1; 175/4.54
(58) Field of Search ..... 166/297, 55.1; 175/5.54, 5.56

(56) References Cited

U.S. PATENT DOCUMENTS

| | | | | |
|---|---|---|---|---|
| 2,986,214 A | * | 5/1961 | Wiseman, Jr., et al. | 102/310 |
| 3,706,344 A | * | 12/1972 | Vann | 166/297 |
| 5,050,672 A | * | 9/1991 | Huber et al. | 166/55 |
| 5,058,680 A | * | 10/1991 | Huber et al. | 166/297 |
| 5,191,936 A | * | 3/1993 | Edwards et al. | 166/297 |
| 5,366,014 A | * | 11/1994 | George | 166/297 |
| 5,992,289 A | * | 11/1999 | George et al. | 166/297 |
| 6,098,716 A | * | 8/2000 | Hromas et al. | 166/242.6 |
| 6,220,370 B1 | * | 4/2001 | Wesson et al. | 102/320 |

OTHER PUBLICATIONS

Halliburton "Slickline–Retrievable TDF Firing Head" Brochure Sheet (1998).

* cited by examiner

*Primary Examiner*—Hoang Dang
(74) *Attorney, Agent, or Firm*—William M. Imwalle; Marlin R. Smith

(57) ABSTRACT

A latching system permits a firing head to be lowered into a wellbore and reliably coupled to a perforating gun previously lowered into the wellbore. In a disclosed embodiment thereof, the latching system includes a tubular collar associated with the firing head, and a stinger associated with the perforating gun. As the firing head approaches the previously lowered perforating gun, shearable studs projecting into the interior of the collar are received in external side surface J-slots formed on the stinger. The latching of the collar studs in the stinger J-slots permits the firing head/perforating gun connection to be verified simply by pulling up on and creating increased tension in the structure, such as a slick line, used to lower the firing head to the perforating gun. After the firing head is used to detonate the perforating gun, the spent firing head may be retrieved by pulling it uphole with sufficient force to shear its collar studs. Cooperating auxiliary attachment structures are formed on the firing head and perforating gun to facilitate their interconnection and simultaneous lowering into the wellbore if desired.

28 Claims, 4 Drawing Sheets

FIRING HEAD/PERFORATING GUN LATCHING SYSTEM AND ASSOCIATED METHODS

BACKGROUND OF THE INVENTION

The present invention generally relates to apparatus operably positionable in the wellbore of a subterranean well and, in a preferred embodiment thereof, more particularly provides specially designed latching apparatus and associated methods for operatively coupling a firing head structure to a perforating gun.

In subterranean wells, such as oil and gas wells, it is common practice to facilitate the flow of production fluid by perforating a fluid bearing subterranean formation using a device commonly referred to as a perforating gun which is lowered into the wellbore to the depth of the formation and then detonated to form perforations in the formation surrounding the gun. A firing head assembly is operatively coupled to the gun and detonated to fire the gun. While the firing head assembly may be coupled to the perforating gun before the gun is lowered into the wellbore, it is often preferred, for safety and other reasons, to couple the firing head to the gun after the gun is positioned downhole in the wellbore.

For the lowered gun to function, it must be properly coupled to the subsequently lowered firing head. This downhole coupling, or "latching", of the firing head to the associated perforating gun has heretofore been subject to several problems, limitations and disadvantages. For example, one previously proposed firing head/perforating gun latching system utilizes flexible collet fingers on the firing head that are designed to be outwardly deflected over an upper end of an associated stinger portion of the perforating gun, and then snap into a circumferential groove in the stinger to operatively latch the firing head to the perforating gun.

The collet fingers, as they approach the stinger, pass though a centering restriction in the tubing on which the perforating gun has been previously lowered into the wellbore, and through which the firing head passes on its way to the perforating gun. This centering restriction is designed to laterally align the collet fingers with the upper end of the stinger, but can easily be struck by and inwardly bend one or more of the collet fingers, thereby preventing the proper latching between the firing head and the perforating gun. This same undesirable bending of the collet fingers could also result from the collet structure striking some other obstruction or irregularity in the tubing as the collet structure passes through it in a downhole direction toward the previously lowered perforating gun.

A potential solution to this downhole firing head/perforating gun latching problem is simply to attach the firing head to the perforating gun at the surface, and then lower the coupled firing head and perforating head into the wellbore together. However, as previously mentioned, in many instances this is considered undesirable from safety and other standpoints. Additionally, if for some reason the firing head malfunctions, both the firing head and the perforating gun must be pulled from the wellbore, as opposed to simply pulling and replacing the malfunctioning firing head.

As can readily be seen from the foregoing, a need exists for improved apparatus and associated methods for effecting the downhole latching of a firing head to a previously lowered perforating gun. It is to this need that the present invention is directed.

SUMMARY OF THE INVENTION

In carrying out principles of the present invention, in accordance with a preferred embodiment thereof, perforating apparatus is provided which is operatively positionable in a subterranean wellbore and includes a firing head and an associated perforating gun. Cooperatively engageable first and second latching structures are preferably of fixed geometry configurations, are respectively carried by the firing head and the perforating gun, and are operative to couple them, while in the wellbore, in a manner such that subsequent operation of the firing head responsively fires the perforating gun. According to an aspect of the present invention, a portion of one of the first and second latching structures is shearable in a manner permitting the firing head, after being coupled to the perforating gun in the wellbore, to be disengaged from the perforating gun and retrieved from the wellbore.

In an illustrated embodiment of the present invention, the first latching structure is representatively a tubular latch collar portion of the firing head and has a circumferentially spaced plurality of shearable lugs extending radially inwardly into its interior. The second latching structure is representatively a stinger portion of the perforating gun, is telescopingly receivable in the latch collar, and has a circumferentially spaced plurality of J-slot recesses formed on an exterior sidewall portion thereof. As the latch collar is telescoped onto the stinger, the shearable studs enter the stinger J-slots to couple the firing head to the perforating gun.

In accordance with a method of the invention, the perforating gun is lowered into the wellbore to a predetermined depth therein and held at such predetermined depth. The firing head is then lowered, on a suitable lowering structure such as a slickline, into the wellbore until the latching portions of the firing head and perforating gun are interengaged. The slickline is then pulled up to verify, via a sensed increase in its tension, that the lowered firing head has been properly latched to the previously lowered perforating gun. After proper firing head/perforating gun latching has been verified the firing head is appropriately actuated to responsively fire the perforating gun. Subsequent to the firing of the perforating gun, the spent firing head is pulled up with sufficient force to shear the shearable portion of the latching structure, for example the shearable latch collar studs, thereby releasing the firing head from the perforating gun and permitting the unlatched firing head to be pulled out of the wellbore.

According to another aspect of the present invention, cooperative auxiliary connecting structures are provided on the interengageable latching portions of the firing head and perforating gun which permit them to be fixedly secured to one another in a manner permitting the perforating gun and firing head to be simultaneously lowered into the wellbore in an operatively connected state instead of being sequentially lowered into the wellbore and operatively latched together therein. Representatively these cooperative auxiliary connecting structures include a circumferentially spaced plurality of openings formed in the sidewall of the latch collar and alignable with side surface depressions in the stinger, and connecting members extendable through the collar openings into the stinger depressions to longitudinally and rotationally lock the collar onto the stinger.

Figure 2:
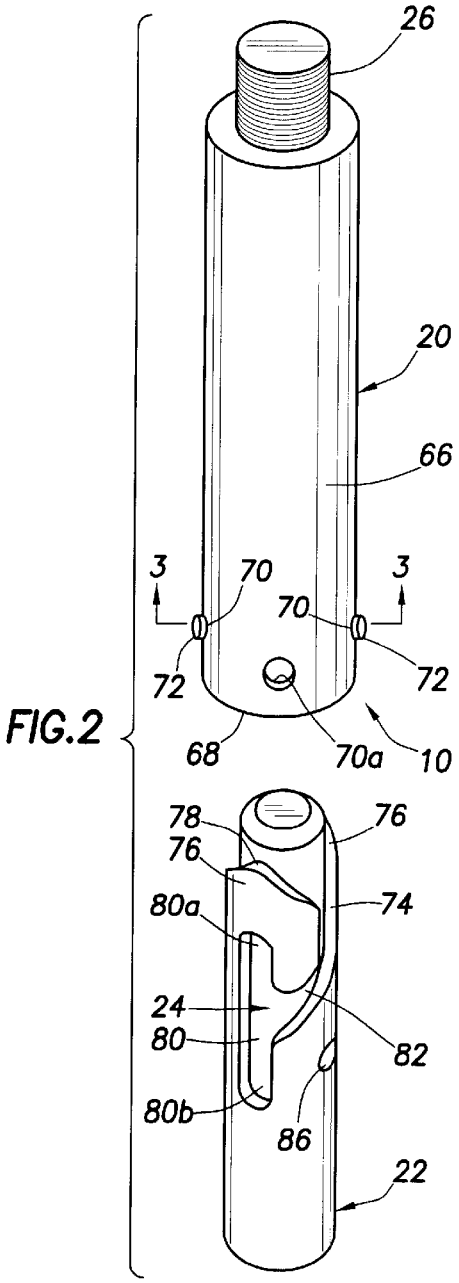
Figure 3:
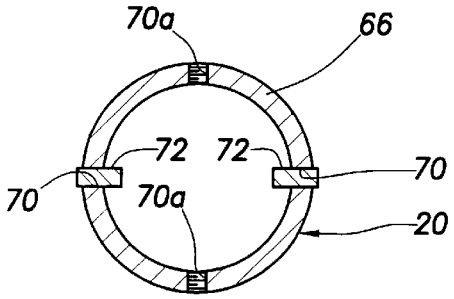
Figure 4:
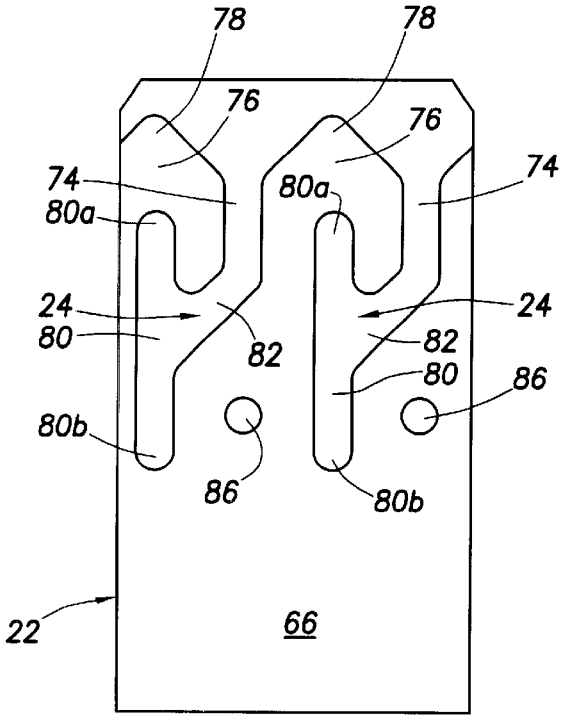

FIG. 2 is an exploded perspective view of latching collar and stinger portions of the latching assembly;

FIG. 3 is an enlarged scale cross-sectional view through a lower end of the latching collar structure illustrated in FIG. 2 and showing diametrically opposed shearable stud members incorporated therein; and FIG. 4 is a developed side elevational view of the stinger structure shown in FIG. 2 and illustrating an opposed pair of external J-slots formed thereon for operatively receiving the shearable stud members.

DETAILED DESCRIPTION

Figure 1A:
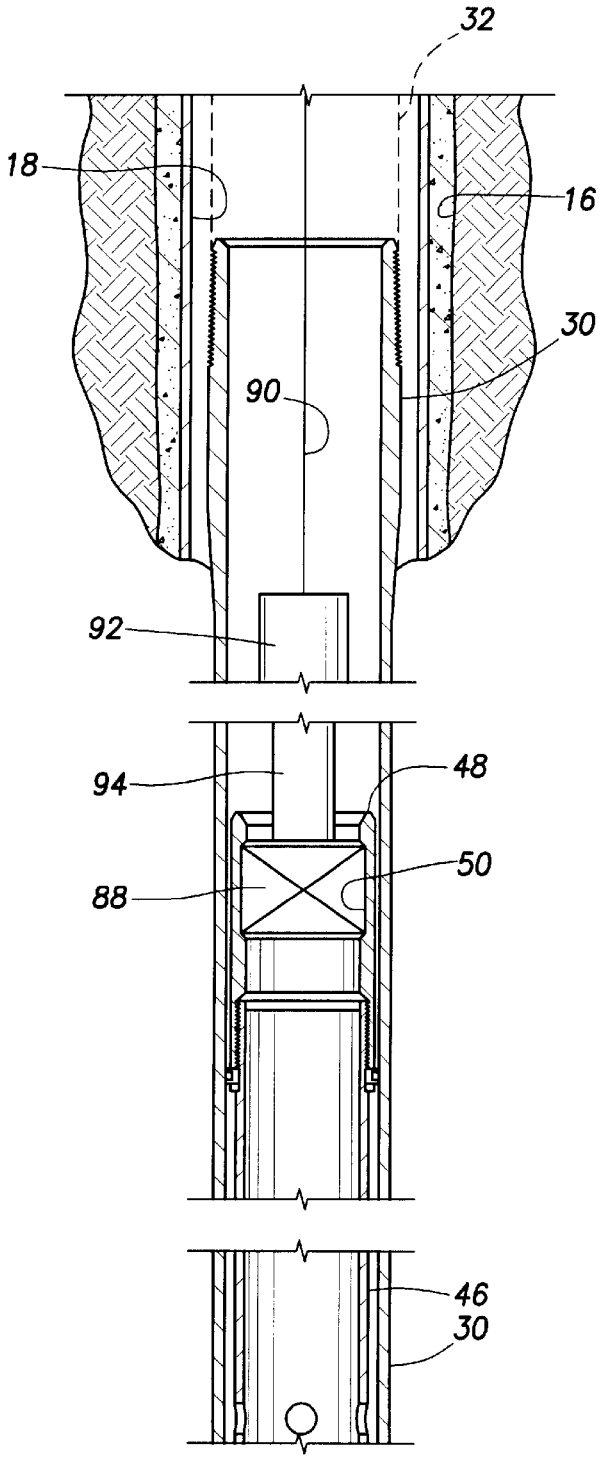
FIGS. 1A–1F are cross-sectional views of longitudinally successive portions of a representative firing head/ perforating gun assembly having incorporated therein a specially designed firing head/perforating gun latching system embodying principles of the present invention.
Figure 1B:
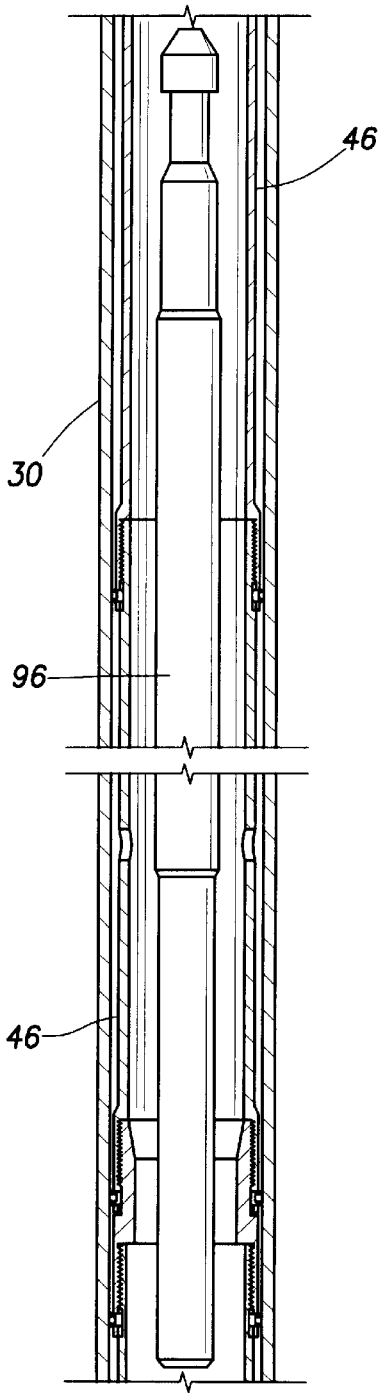
Figure 1C:
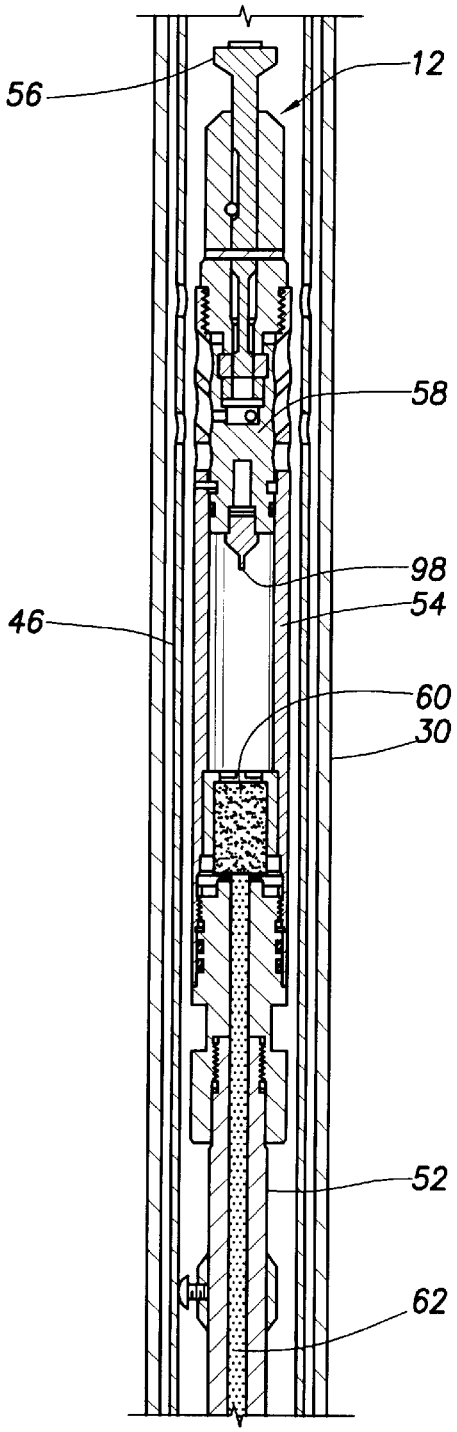
Figure 1D:
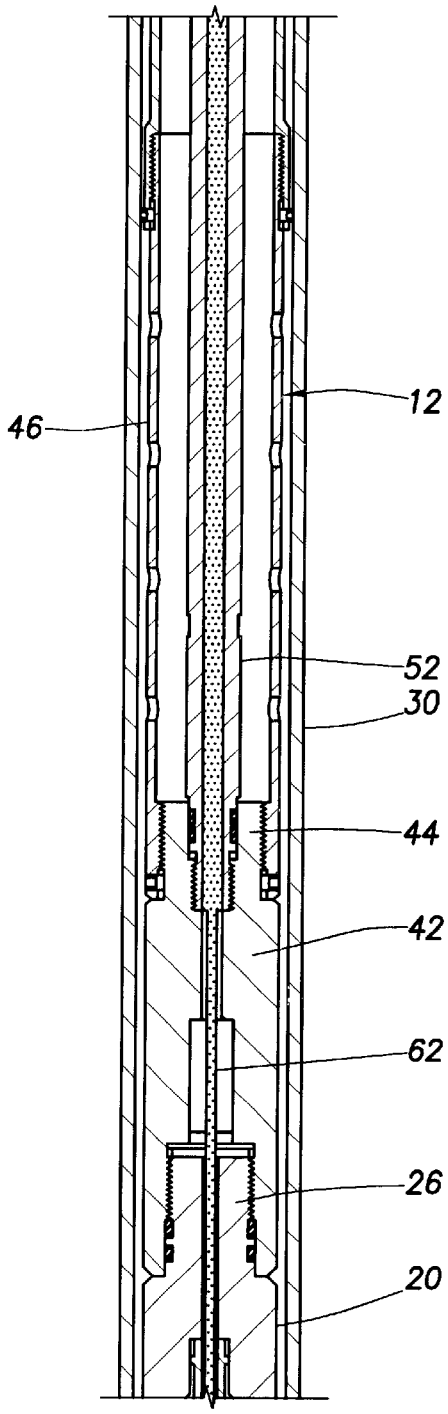
Figure 1E:
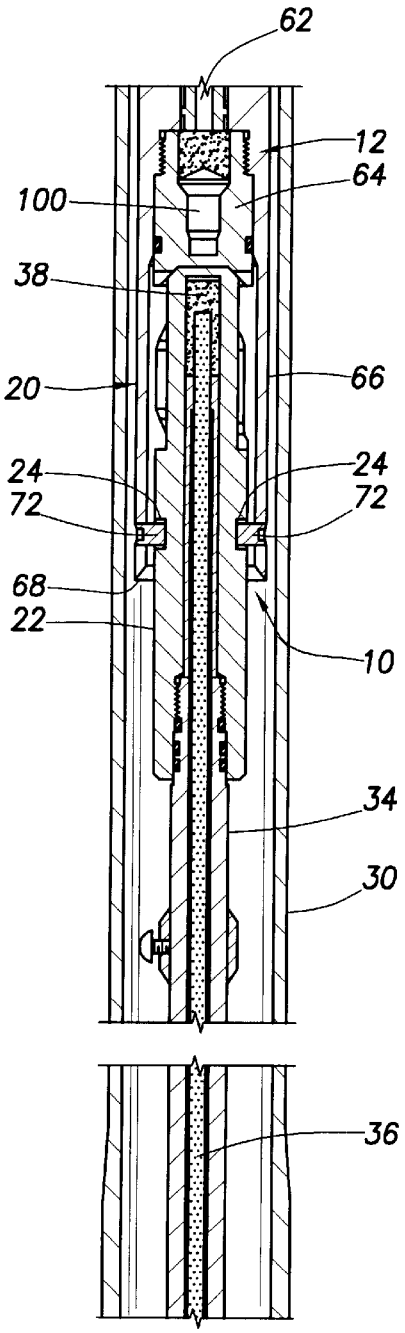
Figure 1F:
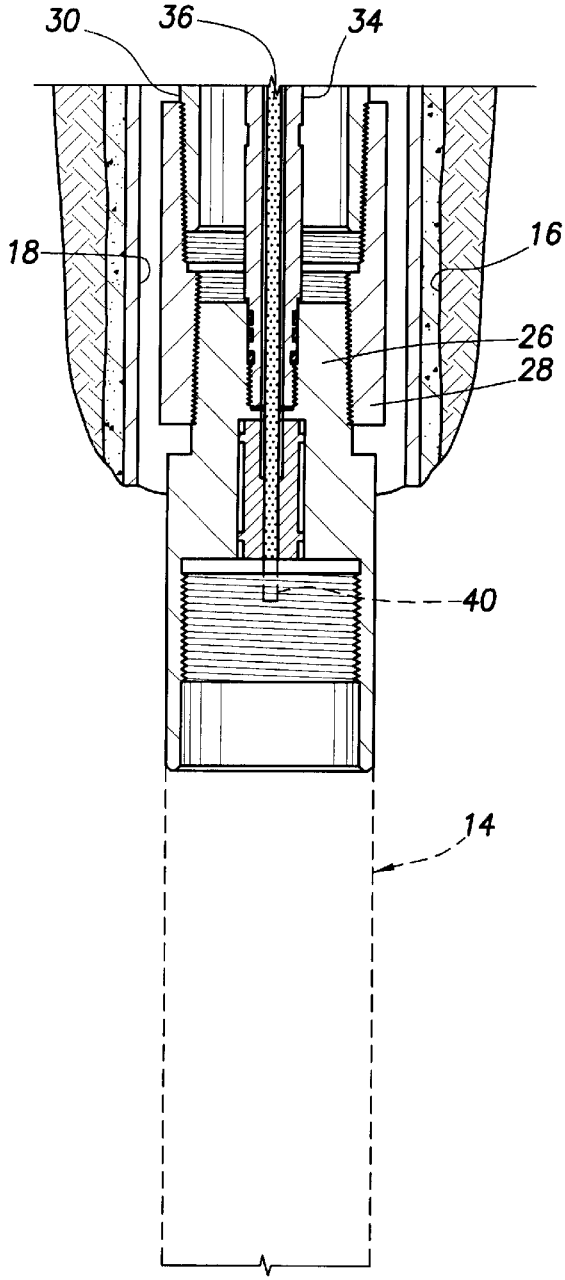

The present invention provides specially designed latching apparatus 10 (see FIGS. 1E and 2) useable to releasably latch a firing head 12 (see FIGS. 1C–1E) to a perforating gun 14 (see FIG. 1F) downhole within a subterranean wellbore 16, portions of which are illustrated in FIGS. 1A and 1F. Representatively, the wellbore 16 is lined in a conventional manner with a cemented-in tubular casing structure 18, but the principles of the present invention are also applicable to uncased wellbores. As subsequently described herein, the latching apparatus 10 includes a tubular latching collar structure 20 (see FIGS. 1E and 2) that defines a lower end portion of the firing head 12, and a tubular stinger structure 22 (see FIGS. 1E and 2) having a pair of external J-slots 24 formed on opposite external side portions thereof. The stinger structure 22 defines an upper end portion of the overall perforating gun assembly.

The schematically depicted perforating gun 14 (FIG. 1F) is of a conventional construction and has a reduced diameter threaded upper end portion 26 which is connected to a threaded tubular crossover member 28 which, in turn, is threadingly coupled to the lower end of an outer tubular structure 30 used to lower the perforating gun 14 through the casing 18 to a predetermined depth therein adjacent a subterranean formation (not shown) to be penetrated as a result of firing the perforating gun 14. The upper end of the tubular structure 30 (see FIG. 1A) is threadingly coupled to the lower end of a tubing structure 32 extending to the surface.

Extending upwardly from the perforating gun 14 is an extension tube 34 (see FIGS. 1E and 1F) which is threaded at its upper end into the lower end of the stinger 22. A detonator cord 36 extends through the interior of the extension tube 34, and into the interior of the stinger 22. As illustrated in FIG. 1E, the upper end of the detonator cord 36 is communicated with an initiator 38 within an upper end portion of the stinger 22, and as illustrated in FIG. 1F the lower end of the detonator cord 36 is communicated with a booster 40 in an upper end portion of the perforating gun 14.

The firing head 12 is representatively of a conventional mechanically actuated type, but could be of another known type such as, for example, a pressure-actuated firing head. As previously mentioned, the latch collar 20 (see FIGS. 1D and 1E) defines a lower end portion of the firing head 12. The threaded upper end portion 26 of the latch collar 20, as shown in FIG. 1D, is threaded into the lower end of a tubular crossover member 42 having an upper end 44 that is threaded into the lower end of an inner tubular structure 46 (see FIGS. 1A-A-1D) coaxially received within the outer tubular structure 30 and axially movable relative thereto. For purposes later described herein, an open upper end portion 48 of the inner tubular structure 46 (see FIG. 1A) has an annular latching profile 50 formed on its inner side surface.

Turning now to FIG. 1D, an extension tube 52 is coaxially received in the inner tubular structure 46 and has a lower end portion threaded into the upper end portion 44 of the crossover member 42. At its upper end, the extension tube 52 is coupled to a somewhat larger diameter tubular member 54 (see FIG. 1C). Operatively secured to the upper end of the tubular member 54, and defining an upper end portion of the firing head 12, is an upper releasing pin 56 which is disposed above a firing piston 58 slidably carried within the tubular member 54. As illustrated in FIG. 1C, the firing piston 58 is disposed in an upwardly spaced relationship with an initiator 60 carried within the tubular member 54. Initiator 60 is operatively coupled to a detonator cord 62 (see FIGS. 1C–1E) that extends downwardly from the initiator 60, through the extension tube 52 and the crossover member 42, to a shape charge assembly 64 secured within an upper interior end portion of the latch collar portion 20 of the firing head 12.

With reference now to FIGS. 2 and 3, the latch collar 20 has a tubular body 66 with an open lower end 68. Four internally threaded circular holes 70,70*a* are equally spaced, in diametrically opposite pairs, around the circumference of a lower end portion of the collar body 66. For purposes later described, shearable metal studs 72 are threaded into a diametrically opposite pair of holes 70 so that inner end portions of the studs 72 extend into the interior of the collar body 66 as illustrated in FIGS. 1E and 3.

Turning now to FIGS. 2 and 4, each of the previously mentioned opposite J-slots 24 externally formed on the outer side surface of the stinger 22 has a longitudinally extending upper entry portion 74 positioned between a pair of deflector portions 76 of the stinger having generally inverted V-shaped apex sections 78. Each J-slot entry portion 74 is communicated with a circumferentially offset, longitudinally extending receiving portion 80 by a downwardly sloping transfer portion 82. Each receiving portion 80 has an upper portion 80*a*, and a lower portion 80*b*. The entry portions 74 of the J-slots 74 are diametrically opposite from one another, as are the receiving portions 80 of the J-slots 74.

To operatively attach the collar 20 to the stinger 22, as later described herein, the collar 20 is simply dropped onto the upper end of the stinger 22. The inwardly projecting end portions of the shearable studs 72 either drop directly into the J-slot entry portions 74 or are rotationally deflected by the apexed deflectors 76 into the entry portions 74 (thus causing the collar 22 to rotate relative to the stinger 22). The lugs 72 are then directed into the J-slot receiving portions 80 via the J-slot transfer portions 82 (thereby further rotating the collar 20 relative to the stinger 22) whereupon the lugs drop into the lower receiving slot portions 80*b*. When the collar 20 is subsequently lifted, the lugs 72 enter the upper receiving slot portions 80*a*, thereby locking the collar 20 the stinger 22.

For purposes later described herein, the in-place collar 20 may be fixedly secured to the stinger 22 which it coaxially overlaps using threaded studs 84 (see FIG. 2) These studs 84 are threaded into the diametrically opposite pair of collar holes 70*a* (see FIGS. 2 and 3) until the studs 84 enter a diametrically opposite pair of circular recesses 86 formed in the outer side surface of the stinger 22. This translationally and rotationally locks the collar 20 to the stinger 22.

The use of the perforating gun 14, utilizing the specially designed firing head/perforating gun latching apparatus 10 of the present invention, will now be described with reference to FIGS. 1A–1E. To position the perforating gun 14 for subsequent firing, the gun 14 (see FIG. 1F) is lowered to a preselected depth in the wellbore 16 on the outer tubular structure 30 secured to the lower end of the upper tubing structure 32 (see FIG. 1A). The firing head 12 is prepared for lowering into the outer tubular structure 30 by latching a schematically depicted pulling tool 88 (see FIG. 1A) into the internal profile 50, and interconnecting the latched-in pulling tool 88 to a lowering structure, such as the illustrated slickline 90, via a conventional telescoped weight and jar assembly 92,94 which is schematically depicted in FIG. 1A. Lowering structures other than the representatively illustrated slickline 90, such as coiled or jointed tubing, or wireline, could be alternatively utilized if desired.

The slickline-supported firing head structure 12, whose lower end is defined by the specially designed latch collar 20, is lowered into the outer tubular structure 30 toward the upper stinger end portion 22 of the in-place perforating gun 14 until the latch collar 20 telescopes over the stinger 22 and the shearable collar studs 72 (see FIGS. 1E and 3) enter the lower end portions 80*b* of the stinger J-slot receiving portions 80 (see FIG. 4). As previously described, during the downward movement of the collar 20 over the stinger 22, the shearable studs 72 sequentially pass downwardly through the J-slot portions 74, circumferentially and downwardly through the transfer portions 82, and then downwardly into the lower end portions 80*b* of the J-slot receiving portions.

To verify that the lowered collar 20 is latched to the stinger 22, thereby operatively coupling the firing head 12 to the perforating gun 14, the slickline 90 is pulled upwardly in a manner causing the inner end portions of the collar studs 72 to move upwardly in the J-slot receiving portions 80 until they enter the upper portions 80*a* thereof and bottom out against their upper ends. A resulting sensed substantial increase in the slickline tension verifies that the collar 20 has been operatively latched to the stinger 22.

After the operative collar/stinger latching has been verified in this manner, slack is appropriately introduced into the slickline 90 in a manner causing the weight 92 to strike and "shear down" the slickline pulling tool 88 out of its associated tubing profile 50. The slickline 90 is then pulled upwardly to remove the now unlatched pulling tool 88 from the wellbore 16 leaving the firing head 12 operatively latched to the perforating gun 14. As will be appreciated, as alternatives to the weight and jar structure 92,94, other types of jarring mechanisms or other types of unlatching mechanisms may be utilized to decouple the pulling tool 88 from the inner tubular structure 46 Subsequent to the removal of the pulling tool 88 in this manner, a suitable drop bar 96 (see FIG. 1B) is dropped through the inner tubular structure 46 and permitted to fall on the upper releasing pin portion 56 of the firing head structure 12. In response to the impact of the drop bar 96 on the releasing pin 56, the firing piston 58 is driven downwardly against the underlying initiator 60 to thereby cause a depending firing pin 98 on the piston 58 to penetrate the initiator 60 and ignite the explosive material therein. This ignites the detonator. cord 62 (see FIGS. 1C–1E) which, in turn, operates the booster 64 to thereby drive a shape charge 100 therein downwardly through the upper end wall of the stinger 22. The shape charge penetration of the upper stinger end wall operates the stinger initiator 38 in a manner igniting the perforating gun detonating cord 34 (see FIGS. 1E and 1F) and, in turn, operating the perforating gun booster 40 (see FIG. 1F). Operation of the booster 40 fires the perforating gun 14 and, in a conventional manner, drives its shape charges (not shown) outwardly through the cased wellbore 16 into the surrounding subterranean formation (also not shown).

After the perforating gun 14 has been fired, the spent firing head 12 may be retrieved by lowering the pulling tool 88 on the slickline 90 (see FIG. 1A) into latched receipt with the inner tubular structure profile 50, and then pulling upwardly on the slickline 90 with sufficient force to shear the collar lugs 72, thereby freeing the collar 20 from the stinger 22 and correspondingly freeing the firing head structure 12 from the perforating gun 14. Once freed in this manner from the perforating gun 14, the firing head 12 may be simply pulled out of the wellbore 16 on the slickline 90. This also permits the drop bar 96 to be brought to the surface without the necessity of a separate trip.

As an alternative to first lowering the perforating gun 14 into the wellbore 16 and then separately lowering the firing head 12 into the wellbore 16 and latching the separately lowered firing head 12 to the perforating gun 14, the same collar 20 may be used to operatively secure the firing head 12 to the perforating gun 14 in a manner permitting the firing head and perforating gun to be simultaneously lowered into the wellbore 16. This alternate connection of the firing head 12 and the perforating gun 14 may be achieved simply by latching the collar 20 to the stinger 22, using the studs 72 threaded into the collar holes 70*a* until inner ends of the studs 72 enter the stinger side recesses 86. This longitudinally and circumferentially locks the collar 20 to the stinger 22, thereby locking the firing head 12 to the perforating gun 14 for simultaneous lowering into the wellbore 16.

As can be seen, in contrast to the use of resilient collet fingers to operatively couple a firing head to an associated perforating gun, the present invention representatively utilizes latching structures (i.e., the latching structures 20 and 22) which preferably have fixed geometry configurations. As used herein, the term "fixed geometry" with respect to these latching structures means that their configurations are not appreciably altered during the latching operation. The latching operation is thus not dependent on the resilient deflection of any portion of the structures 20 and 22, and neither structure is appreciably susceptible to deformation or other damage while being lowered through the wellbore. Additionally, because of the rigid yet intentionally shearable nature of the firing head/perforating gun latching interconnection, both the verification of proper latching and the subsequent separation of the latched firing head and perforating gun are substantially facilitated.

The unique latching apparatus of the present invention thus provides for more reliable downhole latching of a firing head to a perforating gun and, via the shearable interconnection between the firing head and the perforating gun, permits the easy retrieval of the spent firing head from the perforating gun. The same firing head, however, may be alternatively attached directly to the perforating gun, as described above, to facilitate the joint lowering of the firing gun and attached perforating gun into the wellbore. Additionally, by using a drop-away attachment instead of the threaded crossover member 28 illustrated in FIG. 1F, the perforating gun 14 and attached firing head 12 may be simply dropped into the wellbore 16 after the perforating gun 14 is actuated by the firing head 12. Moreover, if well parameters change such that a different firing head is required, the firing head in place can be retrieved and a new firing head redeployed without having to trip the perforating gun.

The foregoing detailed description is to be clearly understood as being given by way of illustration and example only, the spirit and scope of the present invention being limited solely by the appended claims.

What is claimed is:

1. Apparatus operatively positionable in a subterranean wellbore, comprising:

a firing head;

a perforating gun; and cooperatively engageable fixed geometry first and second latching structures respectively carried by the firing head and the perforating gun for coupling them while in the wellbore in a manner such that subsequent operation of the firing head responsively fires the perforating gun.

2. The apparatus of claim 1 wherein a portion of one of the first and second latching structures is shearable in a manner permitting the firing head, after being coupled to the perforating gun in the wellbore, to be disengaged from the perforating gun and retrieved from the wellbore.

3. The apparatus of claim 1 wherein:

one of the first and second latching structures has a shearable projecting portion thereon, the other one of the first and second latching structures has a recessed area adapted to receive the projecting portion, and the first and second latching structures, when operatively coupled, are forcibly disengageable from one another by shearing the projecting portion.

4. The apparatus of claim 3 wherein the recessed area has a J-slot configuration.

5. The apparatus of claim 1 wherein:

one of the first and second latching structures is a tubular latch collar having a sidewall with a plurality of circumferentially spaced, radially inwardly extending projections thereon, and the other one of the first and second latching structures is a stinger structure having a sidewall with a plurality of exterior J-slot recesses formed therein.

6. The apparatus of claim 5 wherein the latch collar is disposed on the firing head.

7. The apparatus of claim 1 wherein the first and second latching structures are telescopable with one another.

8. The apparatus of claim 1 further comprising cooperatively engageable auxiliary connecting structures disposed on the firing head and the perforating gun and useable to operatively couple them in a fixed relationship for simultaneous lowering into the wellbore.

9. Apparatus operatively positionable in a subterranean wellbore, comprising:

a firing head;

a perforating gun; and cooperatively engageable fixed geometry first and second latching structures respectively carried by the firing head and the perforating gun for coupling them while in the wellbore, in response to the lowering of the firing head to the perforating gun within the wellbore, in a manner such that subsequent operation of the firing head responsively fires the perforating gun, the cooperatively engageable first and second latching structures including a recess area formed in one of the first and second latching structures, and a rigid, shearable projecting portion carried by the other one of the first and second latching structures and receivable in the recess area in response to the lowering of the firing head to the perforating gun within the wellbore.

10. The apparatus of claim 9 wherein:

the first and second latching structures are telescopable with one another in a first direction, the rigid, shearable projecting portion is defined by a plurality of spaced apart shearable members carried by the other one of the first and second latching structures and projecting therefrom in a second direction perpendicular to the first direction, and the recess area is defined by a plurality of exterior J-slot recesses formed on the one of the first and second latching structures.

11. The apparatus of claim 10 wherein:

the hearable members are carried by the first latching structure, and the plurality of exterior J-slot recesses are formed on the second latching structure.

12. The apparatus of claim 11 wherein:

the first latching structure is a tubular latch collar portion of the firing head, the shearable members are a plurality of radially inwardly projecting studs carried by the latch collar, the second latching structure is a stinger portion of the perforating gun telescopingly receivable in the latch collar, and the exterior J-slot recesses are formed on an exterior sidewall of the stinger portion.

13. The apparatus of claim 12 further comprising cooperatively engageable auxiliary connecting structures disposed on the firing head and the perforating gun and useable to operatively couple them in a fixed relationship for simultaneous lowering into the wellbore.

14. The apparatus of claim 13 wherein the cooperatively engageable auxiliary connecting structures include a sidewall opening in the latch collar, a sidewall recess on the stinger alignable with the sidewall opening in the latch collar, and a fastening member extendable through the sidewall opening in the latch collar and into the sidewall recess on the stinger.

15. The apparatus of claim 9 further comprising cooperatively engageable auxiliary connecting structures disposed on the firing head and the perforating gun and useable to operatively couple them in a fixed relationship for simultaneous lowering into the wellbore.

16. The apparatus of claim 15 wherein the cooperatively engageable auxiliary connecting structures are associated with the first and second latching structures.

17. A method of operating a perforating gun comprising the steps of:

lowering the perforating gun into a subterranean wellbore to a predetermined depth therein;

lowering a firing head through the wellbore to the perforating gun;

latching the firing head to the perforating gun within the wellbore using a shearable latching connection therebetween;

operating the firing head to responsively fire the perforating gun;

shearing the latching connection to release the firing head from the perforating gun; and removing the released firing head from the wellbore.

18. The method of claim 17 wherein the latching step is performed using the step of causing a shearable portion of one of the firing head and the perforating gun to enter a recess area of the other one of the firing head and the perforating gun.

19. The method of claim 18 wherein the causing step is performed by causing a shearable portion of the firing head to enter a J-slot recess area on the perforating gun.

20. The method of claim 18 wherein:

the firing head has a tubular latch collar portion with a circumferentially spaced plurality of radially inwardly projecting shearable members, the perforating gun has a stinger portion telescopingly receivable within the latch collar and having a plurality of exterior J-slot recesses formed thereon, and the causing step is performed by causing the shearable studs to enter the exterior J-slot recesses.

21. The method of claim 17 wherein:

the step of lowering the firing head is performed by lowering the firing head into the wellbore on a lowering structure connected to the firing head, and the method further comprises the step, performed after the latching step and prior to the operating step, of verifying that he firing head has been properly latched to the perforating gun, the verifying step being performed by creating an increased tension force in the lowering structure.

22. The method of claim 21 wherein the step of lowering the firing head is performed using a slickline attached to the firing head.

23. A method of operatively connecting a firing head to a perforating gun, the method comprising the steps of:

forming a shearable projection portion on a section of one of the firing head and the perforating gun;

forming a recessed area on a section of the other one of the firing head and the perforating gun, the recessed area being adapted to receive the projection portion in a manner operatively connecting the firing head to the perforating gun and permitting them to be disconnected from one another by exerting a disconnection force thereon to shear the projection portion; and causing the shearable projection portion to enter the recessed area.

24. The method of claim 23 wherein the causing step is performed by telescoping the sections.of the firing head and perforating gun.

25. The method of claim 24 further comprising the steps of:

configuring the firing head section as a latch collar, and configuring the perforating gun section as a stinger structure.

26. The method of claim 25 further comprising the steps of:

disposing the projection portion to extend radially into the interior of the latch collar, and configuring the recessed area as a plurality of exterior J-slot recesses on the stinger.

27. The method of claim 26 further comprising the step, performed after the causing step, of anchoring the firing head to the perforating gun in a manner facilitating their simultaneous lowering into a subterranean wellbore.

28. The method of claim 23 wherein:

the method further comprises the steps of lowering the perforating gun into a subterranean wellbore, and lowering the firing head into the wellbore toward the perforating gun, and the causing step is performed in the wellbore.

* * * * *